US011028464B2

(12) United States Patent
Xu et al.

(10) Patent No.: US 11,028,464 B2
(45) Date of Patent: Jun. 8, 2021

(54) LEAD-FREE EASY-TO-CUT CORROSION-RESISTANT BRASS ALLOY WITH GOOD THERMOFORMING PERFORMANCE

(71) Applicant: XIAMEN LOTA INTERNATIONAL CO., LTD., Fujian (CN)

(72) Inventors: Chuankai Xu, Xiamen (CN); Zhenqing Hu, Xiamen (CN); Nianrun Zhou, Xiamen (CN); Siqi Zhang, Xiamen (CN); Jia Long, Xiamen (CN); Huawei Zhang, Xiamen (CN)

(73) Assignee: XIAMEN LOTA INTERNATIONAL CO., LTD., Xiamen (CN)

( * ) Notice: Subject to any disclaimer, the term of this patent is extended or adjusted under 35 U.S.C. 154(b) by 0 days.

(21) Appl. No.: 14/765,305

(22) PCT Filed: Jan. 24, 2014

(86) PCT No.: PCT/CN2014/071362
§ 371 (c)(1),
(2) Date: Nov. 3, 2015

(87) PCT Pub. No.: WO2014/117684
PCT Pub. Date: Aug. 7, 2014

(65) Prior Publication Data

US 2016/0068931 A1 Mar. 10, 2016

(30) Foreign Application Priority Data

Feb. 1, 2013 (CN) ..... 201310044722.2

(51) Int. Cl.
*C22C 9/04* (2006.01)
*C22F 1/08* (2006.01)

(52) U.S. Cl.
CPC . *C22C 9/04* (2013.01); *C22F 1/08* (2013.01)

(58) Field of Classification Search
CPC ..... C22F 1/08
See application file for complete search history.

(56) References Cited

U.S. PATENT DOCUMENTS 5,942,056 A * 8/1999 Singh ..... C22C 9/04 148/434
2004/0234411 A1* 11/2004 Hofmann ..... C22C 9/04 420/473

(Continued)

FOREIGN PATENT DOCUMENTS

CN 101298643 A * 11/2008 ..... C22C 9/04
DE 102005024037 A1 * 4/2006 ..... C22C 9/04

(Continued)

OTHER PUBLICATIONS

JP 2006-265718 machine translation (Year: 2006).*

(Continued)

*Primary Examiner* — Paul A Wartalowicz
*Assistant Examiner* — Stephani Hill
(74) *Attorney, Agent, or Firm* — Lewis Roca Rothgerber Christie LLP

(57) ABSTRACT

The present invention provides a lead-free easy-to-cut corrosion-resistant brass alloy with good thermoforming performance. The brass alloy contains: 74.5-76.5 wt % of Cu, 3.0-3.5 wt % of Si, 0.11-0.2 wt % of Fe, 0.04-0.10% wt % of P, Zn and inevitable impurities. The alloy provided by the present invention has good cold-working and hot-working forming performance, and good dezincification corrosion-resistant and stress corrosion-resistant performance, applies to parts that require cutting and grinding forming in water-heating sanitaryware, electronic appliances, automobiles and the like, and especially applies to production and (Continued)

assembling of complex forging products for which stress is inconvenient to eliminate, such as water taps, values and the like.

11 Claims, 1 Drawing Sheet

(56) References Cited

U.S. PATENT DOCUMENTS

| | | | | |
|---|---|---|---|---|
| 2006/0078458 | A1* | 4/2006 | Strobl | C22C 9/04 420/477 |
| 2007/0062615 | A1* | 3/2007 | Oishi | C22C 9/04 148/434 |
| 2009/0092517 | A1* | 4/2009 | Kosaka | B22F 3/20 420/471 |

FOREIGN PATENT DOCUMENTS

| | | | | |
|---|---|---|---|---|
| DE | 102007013806 | A1 * | 10/2008 | G01R 15/146 |
| JP | 11001736 | A * | 1/1999 | |
| JP | 2002030364 | A * | 1/2002 | |
| JP | 2002069551 | A * | 3/2002 | C22C 9/04 |
| JP | 2004285449 | A * | 10/2004 | C22C 9/04 |
| JP | 2006265718 | A * | 10/2006 | C22C 9/04 |

OTHER PUBLICATIONS

CN 101298643 machine translation (Year: 2008).*
JP 2002-069551 machine translation (Year: 2002).*
JP 2004-285449 machine translation (Year: 2004).*
JP 11-001736 machine translation (Year: 1999).*
DE 102005024037 machine translation (Year: 2005).*
Bavarian et al. "Electrochemical and SCC inhibition of multi-alloy systems using vapor corrosion inhibitors." Materials Performance. Jun. 15-19, 2013. (Year: 2013).*
Eco Brass Tubes (UNS C69300)—Mechanical Properties. AZoM. https://www.azom.com/article.aspxArticleID=7339. Nov. 20, 2012. (Year: 2012).*
JP 2002-030364 machine translation (Year: 2002).*
Brandl et al. "Stress corrosion cracking and selective corrosion of copper-zinc alloys for the drinking water installation." Materials and Corrosion (2009), 60(4), 251-258. (Year: 2009).*
Diehl. Brass Alloys for Drinking Water Applications. DIN 50930—6 S3874 Reduction of Lead in Drinking Water Act. Sep. 2013. (Year: 2013).*
DE 102007013806 machine translation (Year: 2008).*

* cited by examiner

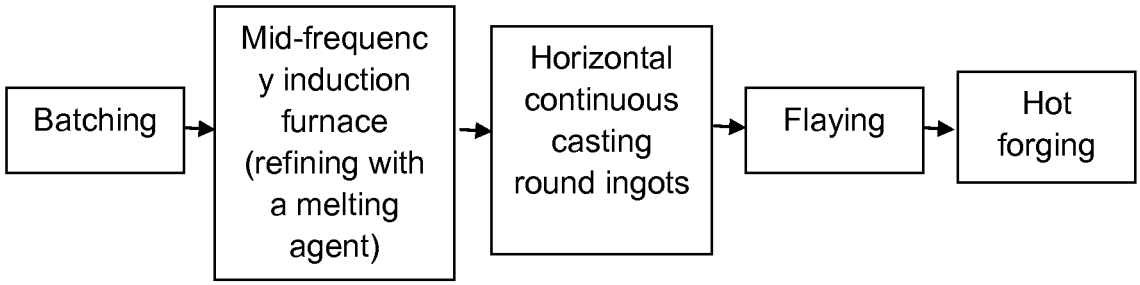
Batching
Mid-frequenc y induction furnace (refining with a melting agent)
Horizontal continuous casting round ingots
Flaying
Hot forging

LEAD-FREE EASY-TO-CUT CORROSION-RESISTANT BRASS ALLOY WITH GOOD THERMOFORMING PERFORMANCE

CROSS-REFERENCE TO RELATED APPLICATION(S)

This application is a National Phase Patent Application and claims priority to and the benefit of International Application Number PCT/CN2014/071362, filed on Jan. 24, 2014, which claims priority to Chinese Patent Application Number 201310044722.2, filed on Feb. 1, 2013, the entire content of all of which are incorporated herein by reference.

TECHNICAL FIELD OF THE INVENTION

The present invention belongs to the technical field of alloys, specifically relates to a lead-free easy-to-cut corrosion-resistant brass alloy, and especially relates to a lead-free easy-to-cut corrosion-resistant brass alloy with excellent thermoforming performance.

BACKGROUND OF THE INVENTION

Lead brass such as C36000 and ZCuZn38Pb2 has been used as an important basic material in fields of electric, mechanic, plumb and the like due to its excellent cuttability and good corrosion resistance obtained by the addition of 1 wt %-4 wt % of lead and its low cost. However, leaded brass may pollute the environment and threaten human health in the process of production and use. Developed countries and districts such as the US and the EU have successively enact standards and decrees, such as NSF-ANSI372, AB-1953, RoHS and the like, to gradually prohibit producing, selling and using leaded products.

At present, a large amount of research work has been done on the free-lead brass which achieve the cuttability mainly by substituting Bi, Sb or Si for Pb, and improve the comprehensive performance of the brass alloy by adding moderate other elements.

However, on the one hand, poor thermoforming performance of the Bi-brass makes it easy to cause defects during thermoforming and difficult to mold complex products, and the welding performance of the Bi-brass is also poor; on the other hand, as Bi is a rare and precious metal, substituting Bi for Pb cannot be implemented in large scale in industry. In addition, after the vavle body is forged with Bi-brass rods provided by many steel manufactures at home and abroad and the valve is assembled, mostly, different degrees of cracks are shown in the ammonia fume experiment as it's inconvenient to anneal to eliminate the assemble stress.

Recently, a lead-free easy-to-cut Sb-brass has been developed in domestic, however, Sb is toxic itself and is very easy to release from the Sb-brass in the process of use, and the release amount of Sb into water of the aquatic products such as the tap, the vavle of the Sb-brass and the like is tested by NSF test to be far more than 0.6 μg/L specified by standard, therefore, hidden troubles of environment pollution and human health threat exist and said Sb-brass cannot be applied in plumb components.

Si-brass is the focus of researches on lead-free easy-to-cut brass and has obtained reasonable quantity of patents. For example, Chinese patent application NO. 200810163930.3 discloses an easy-to-cut Si-brass alloy and the manufacturing method thereof, the chemical components of the Si-brass include: 59.2-65.5 wt % of Cu, 0.35-0.9 wt % of Si, 0.04-0.25 wt % of Pb, 0.22-0.38 wt % of P, 0.005-1.1 wt % of other elements, the balance being Zn and impurities. The Si-brass has good thermoforming performance and cuttability but poor corrosion resistance especially poor resistance to stress corrosion, which is not able to meet the requirement of production inspection and vavles manufactured all show cracks in the ammonia fume experiment. Chinese patent application NO. 200580046460.7 discloses an easy-to-cut brass alloy with tiny amount of Pb, which comprises: 71.5-78.5 wt % of Cu, 2.0-4.5 wt % of Si, 0.005-0.02 wt % of Pb, the balance being Zn. The continuous casting structure of the alloy is bulky and uneven, therefore, it has poor hot-working performance and cannot be applied to mold complex products, in actual production hot extrusion is usually needed to improve the continuous casting structure, which is bound to generate cost increase and resource waste, and it is difficult to achieve technology promotion. Chinese patent NO. 200580019413.3 discloses a copper base alloy casting with refined grain which comprises: 69-88 wt % of Cu, 2-5 wt % of Si, 0.0005-0.4 wt % of Zr, 0.01-0.25 wt % of P, the balance being Zn. The performance of the alloy casting is improved by adding refined grain of Zr into the alloy, but the zirconium resource is rare and expensive, and on the other hand, the zirconium is very easy to combine with oxidizing medium like oxygen and sulphur to transfer into slag and become out of action, which cause great loss of zirconium in smelting waste materials and poor recyclability of the alloy.

SUMMARY OF THE INVENTION

In order to overcome the drawbacks of the prior art, the present invention provides a lead-free easy-to-cut corrosion-resistant brass alloy with excellent thermoforming performance. The brass alloy of the present invention has good comprehensive performance and can be used for producing components such as water taps, valves, conduit joints, electronics, automobiles, machinery and the like.

The purposes of the present invention are achieved through the following technical solutions.

The present invention provides a lead-free easy-to-cut corrosion-resistant brass alloy with excellent thermoforming performance comprising 74.5-76.5 wt % Cu, 3.0-3.5 wt % Si, 0.11-0.2 wt % Fe, 0.04-0.10% wt % P, the balance being Zn and unavoidable impurities.

Preferably, the content of Cu in the brass alloy is: 75-76 wt %.

Preferably, the content of Si in the brass alloy is: 3.1-3.4 wt %.

Preferably, the content of P in the brass alloy is: 0.04-0.08 wt %.

Preferably, the brass alloy further comprises 0.001-0.01 wt % of at least one element selected from the group consisting of B, Ag, Ti and RE.

Preferably, the content of B, Ag, Ti and RE in the brass alloy is 0.001-0.005 wt %.

Preferably, the brass alloy further comprises at least one element selected from the group consisting of Pb, Bi, Se and Te, the content of Pb is 0.01-0.25 wt %, the content of Bi is 0.01-0.4 wt %, the content of Se is 0.005-0.4 wt %, and the content of Te is 0.005-0.4 wt %.

Preferably, the brass alloy further comprises 0.05-0.2 wt % of at least one element selected from the group consisting of Mn, Al, Sn and Ni.

Preferably, the brass alloy further comprises 0.03-0.15 wt % of at least one element selected from the group consisting of As and Sb.

The present invention solves well the corrosion problem of the brass by controlling the content of Cu at 74.5-76.5 wt %. If the content of Cu is more than 76.5 wt %, it will cause that the cost of raw materials of products rises and the forging performance of products decreases. If the content of Cu is less than 74.5 wt %, the mechanical properties especially the elongation rate of alloys will be undesirable. A brittle and hard rick-Si phase can be formed by adding a certain amount of Si into the alloy of the present invention, which plays a role of chip breaking and therefore can improve the cuttability of the brass. If the content of Si is more than 3.5 wt %, the plasticity of the alloy will decrease, therefore, the content of Si is not advisable to exceed 3.5 wt %; and if the content of Si is less than 3.0 wt %, the cuttability and the forgeability will be undesirable, therefore, the content of Si shouldn't be less than 3.0 wt %.

Fe and P should be added simultaneously into the alloy of the present invention. Fe and Si can form a Fe—Si compound with high melting point, the compound is evenly distributed in the matrix in a granular form, which makes the rick-Si phase distribute more evenly and promote the cuttability and the thermoforming performance of the alloy; on the other hand, the Fe—Si compound can prevent the grain from growing fast during recrystallization in hot-working, and thus further improve the thermoforming performance of the alloy. P can also improve the distribution of the rick-Si phase in the alloy and promote the thermoforming performance. The improvement for the thermoforming performance by adding Fe and P simultaneously in the present invention is superior to that by adding Fe and P separately, the presence of Fe and P makes the structure of the alloy fine and uniform and thus obtains increased strength which can satisfy application requirements without hot extrusion after the continuous casting. The content of Fe should be controlled within the range of 0.11-0.2 wt % and the content of P should be controlled within the range of 0.04-0.10 wt %. If the content is lower than the lower limit, the improvement for the thermoforming performance will be unobvious; and if the content exceeds the upper limit, the formability and the mechanical performance of the alloy will decrease.

Adding B, Ag, Ti and RE selectively is to deoxidize and refine grains, and further improve the hot-working performance. An addition amount of no more than 0.01 wt % is advisable, if the amount is too high, the flowability of the alloy melt will decrease.

Considering that the recycling and reuse of easy-to-cut brass waste materials is common in market, Pb, Bi, Se and Te can be added into the alloy, wherein, the content of Pb is 0.01-0.25 wt %, the content of Bi is 0.01-0.4 wt %, the content of Se is 0.005-0.4 wt % and the content of Te is 0.005-0.4 wt %.

The intermetallic compound formed from Mn, Ni and Si can enhance the abrasion resistance of the alloy, and Al can also enhance the strength and the abrasion resistance of the alloy. Adding Sn and Al is intent to enhance the strength and the corrosion resistance of the alloy. In addition, adding these alloying elements is also beneficial for stress corrosion resistance of the alloy. The addition amount of these alloying elements is 0.05-0.2 wt %, if the amount is too low, the effect of enhancing the abrasion resistance will be unobvious, and if the amount is too high, it will be bad for the mechanical performance.

Adding As and Sb is intent to further enhance the dezincification corrosion resistance. The addition amount of As and Sb is 0.03-0.15 wt %, if the amount exceeds the upper limit, the release amount of the metal will go beyond the criterion and the alloy won't be used in components of potable water supply system.

The manufacturing method of the alloy of the present invention comprises: batching, smelting, horizontal continuous casting, flaying and hot forging, wherein, the temperature for horizontal continuous casting is 990-1060° C., and the temperature for hot forging is 650-760° C. The process chart for manufacturing the brass alloy of the present invention is shown as FIG. 1.

The lead-free easy-to-cut brass in the prior art improves its cuttability and corrosion resistance by adding Si, Al, Ni, Mn, Sn, P and the like into Cu—Zn binary system. Si, Fe and P are the main additional elements in the lead-free environmental brass of the present invention, Fe and Si can form a Fe—Si compound having a high melting point, which is evenly distributed in the matrix in a granular form, which makes the distribution of rick-Si phase more dispersive and even and promote the cuttability and the thermoforming performance of the alloy, meanwhile, the Fe—Si compound can prevent the grain from growing fast during recrystallization in hot-working, and thus further improve the thermoforming performance of the alloy. The addition of P can also improve the distribution of the rick-Si phase in the alloy and promote the thermoforming performance. The improvement for the thermoforming performance by adding Fe and P simultaneously in the present invention is superior to that by adding Fe and P separately, the thermoforming performance of the alloy is significantly promoted and meanwhile, excellent mechanical performance, cuttability and corrosion resistance are obtained. Secondly, after adding Si, Fe and P, B, Ag, Ti and RE are selectively added thereinto for further refining the structure in order to promote to the most degree the hot-working performance of the alloy. The selective addition of Mn, Al, Sn and Ni obtains a lead-free corrosion-resistant alloy with excellent thermoforming performance, high strength and high abrasion resistance. The further selective addition of Pb, Bi, Se and Te on the basis of the above alloy obtains a lead-free alloy with excellent thermoforming performance and cuttability which is convenient for recycling and resue. The selective addition of Sb and As obtains a lead-free alloy with excellent thermoforming performance and dezincification corrosion resistance and high strength and abrasion resistance.

Specifically, compared with the prior art, the brass alloy according to the present invention at least possesses the following beneficial effects:

The alloy obtained by adding Fe and P simultaneously according to the present invention has good thermoforming performance and is especially suitable for molding complex products. The cost of production is reduced and the process is simplified without extrusion and direct hot forging using horizontal continuous casting ingots.

No toxic elements such as Pb, Cd and the like are added in the brass alloy according to the present invention, meanwhile, the release amount of the alloy elements into water meets the standard of NSF/ANSI61-2008, therefore, the alloy is a lead-free and environmental alloy. Moreover, as tiny amount of Pb in the alloy is allowed, the recycling problem for waste materials is well solved.

The brass alloy according to the present invention has good usability (such as corrosion resistance, abrasion resistance, mechanical performance and the like) and processing property (such as thermoforming performance, cuttability, welding performance and the like), it can be used in producing components such as water taps, valves, conduit joints, electronics, automobiles and the like, and is especially suitable for producing components of potable water supply system by casting, forging and extruding, such as water taps and various valves.

The thermoforming performance of the alloy according to the present invention is superior to as-cast Si-brass C69300, Bi-brass and traditional Pb-brass C36000, and the alloy according to the present invention can mold into products with complex shapes and meet the requirements without extrusion, and thus gains the advantage for marketing competition.

The stress corrosion resistance and dezincification corrosion resistance of the alloy according to the present invention is significantly superior to Bi-brass, Pb-brass C36000 and other brass alloys.

The abrasion resistance of the alloy according to the present invention is significantly superior to as-cast Si-brass C69300, Bi-brass and traditional Pb-brass C36000.

The alloy according to the present invention has excellent comprehensive performance, its chip shape and cuttability are comparable to Si-brass C69300, Bi-brass and Pb-brass C36000, and its mechanical performance (comprising the tensile strength and elongation rate) is a little more than the conventional Bi-brass and Pb-brass C36000. Meanwhile, the release amount of toxic metal elements into water of the alloy according to the present invention meets the standard of NSF/ANSI61-2008, and the alloy belongs to an environment-friendly material. Therefore, the alloy according to the present invention has more extensive market application prospect.

BRIEF DESCRIPTION OF THE DRAWINGS

FIG. 1 shows a process chart for manufacturing the brass alloy according to the present invention.

DETAILED DESCRIPTION OF THE EMBODIMENTS

The technical solutions of the present invention will be further illustrated with the following examples.

EXAMPLES

Tables 1-4 show the composition of the alloys according to the examples of the present invention, wherein, specific examples of Alloy I according to the present invention are Alloys A01 to A05 in table 1, specific examples of Alloy II according to the present invention are Alloys B01 to B05 in table 2, specific examples of Alloy III according to the present invention are Alloys C01 to C04 in table 3, specific examples of Alloy IV according to the present invention are Alloys D01 to D04 in table 4, and table 5 shows the composition of Alloys 1-11 used for comparison, wherein, the composition of Alloy 1 used for comparison is consistent with that of Japan Sambo C69300, and Alloy 11 used for comparison has the same composition with Alloy C36000.

Both the alloys according to the present invention and the alloys used for comparison were casted through smelting into round rods with the same specification according to the process shown in FIG. 1. Specific preparation process was: batching, smelting, horizontal continuous casting, flaying and hot forging, wherein, the temperature for horizontal continuous casting was 990-1060° C., and the temperature for heat forging was 680-760° C.

The performance testing of the above examples and the alloys used for comparison are performed below. Specific testing items and basis are as follows:

1. Mechanical Performance

The mechanical performance of the alloy were tested according to GB/T228-2010, both the alloys according to the present invention and the alloys used for comparison were processed into standard test samples with a diameter of 10 mm and the tentile test was conducted at room temperature to test the mechanical performance of various alloys. The results were shown in tables 6-10.

2. Cuttability

After the alloys according to the present invention and the alloys used for comparison were processed into robs with a diameter of 34, three parallel-samples with a length of 200 mm were intercepted from each alloy using the same cutter, cutting speed and feeding amount. The cutter model: VCGT160404-AK H01, the rotational speed: 570 r/min, the feeding rate: 0.2 mm/r, the back engagement: 2 mm on one side. "The universal cutting force testing instrument (dynamometer) for broaching, hobbing, drilling and grinding" developed by BUAA (Beijing University of Aeronautics and Astronautics) was used for measuring the cut resistance of the alloys according to the present invention and the alloys used for comparison and collect the chips.

Chips of each kind of alloys were evaluated according to GB/T 16461-1996, wherein, "⊙" represented that aciform chips and unit chips were main, "○" represented that arc cutting was main without subulate chips, "Δ" represented the appearance of short conical spiral chips, and "×" represented the appearance of long conical spiral chips.

The cuttability was evaluated according to the value of the cutting force, taking the C36000 with accepted good cuttability as the standard, namely according to the following formula:

$$X=(\text{cutting force of the C36000}/\text{cutting force of the tested alloy})\times 100\%$$

If "X"≥85%, the cuttability of the tested alloy will be considered excellent and represented with "⊙"; If 85%>"X"≥75%, the cuttability of the tested alloy will be considered moderate and represented with "○"; If 75%>"X"≥65%, the cuttability of the tested alloy will be considered general and represented with "Δ"; If "X"<65%, the cuttability of the tested alloy will be considered poor and represented with "×". Specific results were shown in tables 6-10.

3. Dezincification Corrosion Resistance

The dezincification test was conducted according to GB/T 10119-2008, three parallel-samples with the sectional dimension of 10 mm×10 mm were obtained by cutting different parts of the rob made from the alloys according to the present invention and the alloys used for comparison. The inlayed test samples were placed in the copper chloride solution for corrosion at constant temperature for 24 hours, then the samples were cut into slices and made into metallographic specimens. Observation was performed under the electron metallographic microscope and the average depth of the dezincification layer was calibrated. The results were shown in tables 6-10.

4. Stress Corrosion Resistance

Testing Materials: robs processed from the alloys according to the present invention and the alloys used for comparison, molding products by forging: angle valve with size of ½ inches.

External loading mode: the inlet/outlet was loaded with the union joint, and torque was 90 Nm;

the stress of the assemble products was eliminated without annealing.

Testing conditions: ammonia with a concentration of 14%.

Duration: 8 hours.

Judging method: observing the surface of test samples fumed with ammonia at 15×magnification.

After fumed with ammonia for 8 hours, the test samples were taken out and washed clean with water, the corrosion products on the surface of which were washed with 5% of sulfuric acid solution under the room temperature and rinsed with water and then blow-dried. The surfaces fumed with ammonia were observed at 15× magnification to see whether cracks appear. If there were no cracks on the surface and the corrosion layer was unobvious and the color was bright, it will be shown as "⊙". If there were no obvious cracks on the surface but the corrosion layer was obvious, it will be shown as "○". If there were fine cracks on the surface, it will be shown as "Δ". If there were obvious cracks on the surface, it will be shown as "×". The results were shown in tables 6-10.

5. Hot-Working Performance

A test sample with the length (height) of 40 mm was obtained by cutting from the horizontal continuous casting rods with a diameter of 29 mm, axial compression deformation by hot forging was conducted under the temperature of 680° C. and 750° C., the generation of cracks was observed using the following upsetting rate, the hot forging performance of parts of alloys in tables 1-4 and Alloys 1-8 used for comparison were evaluated.

$$\text{upsetting rate (\%)}=[(40-h)/40]\times 100\%$$ ($h$ represented the height of the test sample after hot upsetting)

If the surface of the test sample for forging was smooth and clean without any cracks, it will be considered excellent and shown as "○". If the surface of the test sample was comparatively rough but without obvious cracks, it will be considered good and shown as "Δ". If there were visual cracks on the surface of the test sample, it will be shown as "×". The results were shown in tables 11-15.

6. The Release Amount of Metals into Water

The release amount of metals into water for the alloys according to the present invention and the alloys used for comparison was measured according to the standard of NSF/ANSI 61-2008, the experimental samples were valves forged and formed from rods, the detecting instrument was inductively coupled plasma mass spectrometry (Varian 820-MS Icp. Mass Spectrometer), the time lasted for 19 days, and the detecting results were shown in table 16.

7. The Test for Abrasion Resistance

The experiment for abrasion resistance of the alloys was conducted according to GB/T12444.1-1990 (the test method for metal abrasion), 45# steel was used as the upper test sample, the alloys in tables 1-5 were made into ring test samples (the lower test sample) with a diameter of 30 mm, the diameter of the center hole was 16 mm and the length (height) was 10 mm. The test samples were lubricated uniformly with general mechanical lubricating oil, the abrasion experiment was conducted under the experimental press of 90N with a stable rotating speed of about 180 r/min, when the abrasion time reached 30 minutes, the test samples were taken down, washed and dried followed by weighed, changes of the weight of the test samples before and after the abrasion were compared, see tables 17-18, the less the loss of weight after abrasion was, the better the abrasion resistance of the alloy was.

TABLE 1 the composition of Alloy I according to the present invention (wt %)

| Alloy | Cu | Si | Fe | P | B | Ag | Ti | RE | Zn |
|---|---|---|---|---|---|---|---|---|---|
| A01 | 75.15 | 3.23 | 0.15 | 0.07 | | | | | balance |
| A02 | 74.69 | 3.21 | 0.19 | 0.07 | 0.002 | | | | balance |
| A03 | 75.18 | 3.09 | 0.12 | 0.10 | 0.001 | 0.001 | | | balance |
| A04 | 76.43 | 3.42 | 0.17 | 0.09 | | | | 0.01 | balance |
| A05 | 75.62 | 3.48 | 0.11 | 0.04 | | | 0.01 | | balance |

TABLE 2 the composition of Alloy II according to the present invention (wt %)

| Alloy | Cu | Si | Fe | P | Pb | Bi | Se | Te | B | Zn |
|---|---|---|---|---|---|---|---|---|---|---|
| B01 | 74.58 | 3.29 | 0.18 | 0.08 | 0.14 | | | | | balance |
| B02 | 76.03 | 3.44 | 0.13 | 0.03 | | | | 0.29 | | balance |
| B03 | 76.47 | 3.05 | 0.11 | 0.06 | | | 0.07 | | | balance |
| B04 | 75.55 | 3.29 | 0.14 | 0.07 | 0.08 | | | | 0.003 | balance |
| B05 | 74.87 | 3.38 | 0.15 | 0.09 | 0.11 | 0.10 | | | 0.002 | balance |

TABLE 3 the composition of Alloy III according to the present invention (wt %)

| Alloy | Cu | Si | Fe | P | Mn | Al | Sn | Ni | B | Ag | RE | Zn |
|---|---|---|---|---|---|---|---|---|---|---|---|---|
| C01 | 74.98 | 3.19 | 0.15 | 0.09 | 0.15 | | | 0.12 | | | | balance |
| C02 | 75.06 | 3.07 | 0.18 | 0.10 | | | 0.16 | | 0.002 | | | balance |
| C03 | 75.55 | 3.42 | 0.12 | 0.08 | 0.06 | | 0.11 | | | 0.01 | balance | |
| C04 | 74.69 | 3.19 | 0.17 | 0.10 | | 0.07 | | 0.001 | 0.001 | | balance | |

TABLE 4

| the composition of Alloy IV according to the present invention (wt %) | | | | | | | | | | | |
|---|---|---|---|---|---|---|---|---|---|---|---|
| Alloy | Cu | Si | Fe | P | Mn | Al | B | Ag | As | Sb | Zn |
| D01 | 75.82 | 3.28 | 0.13 | 0.03 | 0.19 | | | | 0.12 | | balance |
| D02 | 74.96 | 3.37 | 0.16 | 0.06 | 0.18 | 0.09 | | | | 0.03 | balance |
| D03 | 74.79 | 3.36 | 0.12 | 0.05 | | | | | | 0.05 | balance |
| D04 | 74.52 | 3.12 | 0.17 | 0.08 | | | 0.001 | 0.001 | 0.04 | | balance |

TABLE 5

| the composition of the alloys used for comparison (wt %) | | | | | | | | | | | |
|---|---|---|---|---|---|---|---|---|---|---|---|
| Alloys used for comparison | Cu | Si | Fe | P | Mn | Al | Sn | B | Pb | Bi | Zn |
| 1 | 75.51 | 3.17 | 0.03 | 0.05 | | | | | | | balance |
| 2 | 77.84 | 3.39 | 0.02 | 0.09 | | | | | | | balance |
| 3 | 74.02 | 3.32 | 0.02 | 0.07 | | | | | | | balance |
| 4 | 74.97 | 3.63 | 0.14 | 0.06 | | | | | | | balance |
| 5 | 75.49 | 2.90 | 0.16 | 0.07 | | | | | | | balance |
| 6 | 75.82 | 3.47 | 0.30 | 0.04 | | | | | | 0.31 | balance |
| 7 | 74.82 | 3.51 | 0.17 | 0.06 | | | 0.30 | | | | balance |
| 8 | 76.34 | 3.23 | 0.12 | 0.10 | | 0.25 | | 0.001 | | | balance |
| 9 | 75.85 | 3.34 | 0.15 | 0.09 | 0.28 | | | | | | balance |
| 10 | 63.58 | | 0.83 | | 0.84 | 0.55 | 0.98 | 0.001 | | 0.75 | balance |
| 11 | 61.25 | | | | | | | | 2.75 | | balance |

TABLE 6

| the dezincification corrosion resistance, mechanical performance, cuttability and stress corrosion resistance of Alloy I according to the present invention | | | | | | |
|---|---|---|---|---|---|---|
| | Average depth of the | Mechanical properties | | | | Stress corro- |
| Alloy numbers | dezincification layer/ μm | Tensile strength/ Mpa | Elongation rate/% | Chip shape | Cuttability | sion resistance property |
| A01 | <50 | 450 | 26 | ⊙ | ○ | ○ |
| A02 | <50 | 473 | 24 | ⊙ | ○ | ○ |
| A03 | <30 | 431 | 28 | ○ | Δ | ○ |
| A04 | <10 | 472 | 31 | ⊙ | ○ | ⊙ |
| A05 | <20 | 484 | 29 | ⊙ | ○ | ⊙ |

TABLE 7

| the dezincification corrosion resistance, mechanical performance, cuttability and stress corrosion resistance of Alloy II according to the present invention | | | | | | |
|---|---|---|---|---|---|---|
| | Average depth of the | Mechanical properties | | | | Stress corro- |
| Alloy numbers | dezincification layer/ μm | Tensile strength/ Mpa | Elongation rate/% | Chip shape | Cuttability | sion resistance property |
| B01 | <50 | 483 | 22 | ⊙ | ⊙ | ⊙ |
| B02 | <20 | 471 | 27 | ⊙ | ⊙ | ⊙ |
| B03 | <10 | 440 | 32 | ⊙ | ⊙ | ⊙ |
| B04 | <20 | 452 | 28 | ⊙ | ○ | ⊙ |
| B05 | <50 | 475 | 24 | ⊙ | ⊙ | ○ |

TABLE 8

| the dezincification corrosion resistance, mechanical performance, cuttability and stress corrosion resistance of Alloy III according to the present invention | | | | | | |
|---|---|---|---|---|---|---|
| | Average depth of the | Mechanical properties | | | | Stress corro- |
| Alloy numbers | dezincification layer/ μm | Tensile strength/ Mpa | Elongation rate/% | Chip shape | Cuttability | sion resistance property |
| C01 | <150 | 511 | 19 | ⊙ | ○ | ○ |
| C02 | <20 | 436 | 18 | ⊙ | ⊙ | ⊙ |
| C03 | <30 | 458 | 23 | ⊙ | ⊙ | ○ |
| C04 | <30 | 441 | 26 | ○ | ○ | ○ |

TABLE 9

| the dezincification corrosion resistance, mechanical performance, cuttability and stress corrosion resistance of Alloy IV according to the present invention | | | | | | |
|---|---|---|---|---|---|---|
| | Average depth of the | Mechanical properties | | | | Stress corro- |
| Alloy numbers | dezincification layer/ μm | Tensile strength/ Mpa | Elongation rate/% | Chip shape | Cuttability | sion resistance property |
| D01 | <10 | 458 | 29 | ○ | ○ | ○ |
| D02 | <10 | 521 | 22 | ○ | ○ | ○ |
| D03 | <10 | 495 | 23 | ⊙ | ⊙ | ⊙ |
| D04 | <10 | 507 | 29 | ○ | Δ | ⊙ |

TABLE 10 the dezincification corrosion resistance, mechanical performance, cuttability and stress corrosion resistance of the alloys used for comparison

| Alloys used for comparison | Average depth of the dezincification layer/ μm | Mechanical properties: Tensile strength/ Mpa | Mechanical properties: Elongation rate/% | Chip shape | Cuttability | Stress corrosion resistance property |
|---|---|---|---|---|---|---|
| 1 | <50 | 465 | 30 | ○ | ○ | ○ |
| 2 | <10 | 358 | 35 | ○ | Δ | ⊙ |
| 3 | <100 | 454 | 12 | ⊙ | ○ | Δ |
| 4 | <100 | 471 | 15 | ⊙ | ○ | ○ |
| 5 | <100 | 322 | 38 | Δ | Δ | Δ |
| 6 | <100 | 552 | 16 | ⊙ | ⊙ | ⊙ |
| 7 | <20 | 460 | 11 | ⊙ | ○ | ○ |
| 8 | 100-200 | 430 | 12 | ○ | Δ | ○ |
| 9 | 200-300 | 448 | 27 | ○ | ○ | ○ |
| 10 | >300 | 335 | 20 | ○ | ○ | X |
| 11 | >400 | 416 | 28 | ⊙ | ⊙ | X |

It can be seen from the above results that, the average depth of the dezincification layer of Alloys I, II and III according to the present invention are all less than 100 μm, which are significantly superior to Alloys 8-11 used for comparison and comparable to Alloy 1 used for comparison. The dezincification corrosion resistance of Alloy IV according to the present invention is excellent with an average depth of the dezincification layer within 10 μm which can be considered as no dezincification corrosion occurred, and the alloy is especially suitable for the situations with weakly acidic water or high concentration of chloride salts.

The tensile strength of all the alloys according to the present invention is higher than that of Alloys 2, 5 and 10 used for comparison, and the elongation rate of which is higher than that of Alloys 3,4,6,7 and 8 used for comparison. The chip shape and cuttability of the alloys according to the present invention are comparable to Alloy 1 and superior to Alloy 5 used for comparison. The stress corrosion resistance of the alloys according to the present invention is significantly superior to that of Alloys 10 and 11 used for comparison. In conclusion, the alloys according to the present invention possess excellent mechanical performance, cuttability, dezincification corrosion resistance and stress corrosion resistance, which can meet the application requirement better.

TABLE 11 the test result for the hot forging performance of Alloy I according to the present invention

| | Hot forging performance | | | | | | | |
|---|---|---|---|---|---|---|---|---|
| | Upsetting rate(%), 680° C. | | | | Upsetting rate(%), 750° C. | | | |
| Alloy I | 60 | 70 | 80 | 90 | 60 | 70 | 80 | 90 |
| A01 | ○ | ○ | ○ | Δ | ○ | ○ | ○ | ○ |
| A02 | ○ | ○ | ○ | Δ | ○ | ○ | ○ | Δ |
| A03 | ○ | ○ | ○ | Δ | ○ | ○ | ○ | ○ |
| A04 | ○ | ○ | Δ | Δ | ○ | ○ | ○ | Δ |
| A05 | ○ | ○ | Δ | Δ | ○ | ○ | ○ | ○ |

TABLE 12 the test result for the hot forging performance of Alloy II according to the present invention

| | Hot forging performance | | | | | | | |
|---|---|---|---|---|---|---|---|---|
| | Upsetting rate(%), 680° C. | | | | Upsetting rate(%), 750° C. | | | |
| Alloy II | 60 | 70 | 80 | 90 | 60 | 70 | 80 | 90 |
| B01 | ○ | ○ | ○ | Δ | ○ | ○ | ○ | Δ |
| B02 | ○ | ○ | Δ | X | ○ | ○ | Δ | X |
| B03 | ○ | ○ | Δ | Δ | ○ | ○ | Δ | Δ |
| B04 | ○ | ○ | ○ | Δ | ○ | ○ | ○ | Δ |
| B05 | ○ | ○ | ○ | Δ | ○ | ○ | ○ | Δ |

TABLE 13 the test result for the hot forging performance of Alloy III according to the present invention

| | Hot forging performance | | | | | | | |
|---|---|---|---|---|---|---|---|---|
| | Upsetting rate(%), 680° C. | | | | Upsetting rate(%), 750° C. | | | |
| Alloy III | 60 | 70 | 80 | 90 | 60 | 70 | 80 | 90 |
| C01 | ○ | ○ | Δ | Δ | ○ | ○ | ○ | Δ |
| C02 | ○ | ○ | Δ | X | ○ | ○ | Δ | Δ |
| C03 | ○ | ○ | Δ | Δ | ○ | ○ | ○ | Δ |
| C04 | ○ | ○ | Δ | X | ○ | ○ | Δ | Δ |

TABLE 14 the test result for the hot forging performance of Alloy IV according to the present invention

| | Hot forging performance | | | | | | | |
|---|---|---|---|---|---|---|---|---|
| | Upsetting rate(%), 680° C. | | | | Upsetting rate(%), 750° C. | | | |
| Alloy IV | 60 | 70 | 80 | 90 | 60 | 70 | 80 | 90 |
| D01 | ○ | ○ | ○ | Δ | ○ | ○ | ○ | Δ |
| D02 | ○ | ○ | ○ | Δ | ○ | ○ | ○ | Δ |
| D03 | ○ | ○ | ○ | Δ | ○ | ○ | ○ | ○ |
| D04 | ○ | ○ | ○ | Δ | ○ | ○ | ○ | ○ |

TABLE 15

| the test result for the hot forging performance of the alloys used for comparison | | | | | | | | |
|---|---|---|---|---|---|---|---|---|
| Alloys used for comparison | Hot forging performance | | | | | | | |
| | Upsetting rate(%), 680° C. | | | | Upsetting rate(%), 750° C. | | | |
| | 60 | 70 | 80 | 90 | 60 | 70 | 80 | 90 |
| 1 | ○ | ○ | Δ | X | ○ | Δ | X | X |
| 2 | ○ | Δ | Δ | X | ○ | Δ | X | X |
| 3 | ○ | ○ | ○ | X | ○ | ○ | Δ | X |
| 4 | ○ | ○ | ○ | Δ | ○ | Δ | Δ | X |
| 5 | ○ | X | X | X | ○ | X | X | X |
| 6 | Δ | X | X | X | ○ | Δ | X | X |
| 7 | ○ | ○ | ○ | Δ | ○ | Δ | X | X |
| 8 | ○ | ○ | Δ | X | ○ | ○ | X | X |
| 9 | ○ | ○ | ○ | Δ | ○ | ○ | Δ | X |
| 10 | Δ | X | X | X | X | X | X | X |
| 11 | ○ | ○ | ○ | Δ | ○ | ○ | Δ | Δ |

The data shows that, the upsetting rate of the alloys according to the present invention is significantly higher than that of Alloys 1-8 and 10 and no lower than that of Alloy 11 used for comparison at the same forging temperature. It can be seen that the alloys according to the present invention possess more excellent hot forging performance and are more suitable for molding products with complex shapes, and thus have great advantage in market competition.

TABLE 16

| the test result for the release amount of metals of the tested alloys into water | | | | | | |
|---|---|---|---|---|---|---|
| | Tested elements | | | | | |
| Alloys | Pb (μg/L) | Sb (μg/L) | Mn (μg/L) | Cu (μg/L) | Zn (μg/L) | Others(μg/L) Sn, Se, Te, Tl, As, Cd, Hg |
| A03 | 0.056 | 0.030 | 0.063 | 45.38 | 47.14 | all qualified |
| B02 | 0.098 | 0.056 | 0.121 | 38.25 | 35.16 | |
| C01 | 0.452 | 0.056 | 8.36 | 45.18 | 58.11 | |
| D01 | 0.054 | 0.057 | 4.01 | 31.62 | 54.65 | |
| D03 | 0.061 | 0.52 | 0.093 | 56.21 | 60.02 | |
| Alloy 1 used for comparison (C69300) | 0.033 | 0.041 | 0.056 | 45.84 | 36.32 | |
| Alloy 11 used for comparison (C36000) | 17.8 | 0.001 | 0.025 | 60.24 | 37.55 | |
| NSF 61 standard (μg/L) | ≤5.0 | ≤0.6 | ≤30.0 | ≤130.0 | ≤300.0 | Sn ≤790, Se ≤5.0 Tl ≤0.2, As ≤1.0 Cd ≤0.5, Hg ≤0.2 |

The above data shows that, the release amount of Pb of the alloys according to the present invention into water is much lower than that of Alloy C36000, and the release amount of other elements into water also meets the requirement of NSF/ANSI 61-2008 standard for potable water, which is suitable for producing components of potable water supply system, however, the release amount of Pb of Alloy C36000 into water is far higher than the NSF/ANSI 61-2008 standard for potable water, which is not suitable for producing components of potable water supply system.

TABLE 17

| the statistical result for the abrasion test of the alloys according to the present invention | |
|---|---|
| Alloys | Loss of weight after 30 minutes of abrasion (mg) |
| A01 | 15.5 |
| A02 | 14.5 |
| A03 | 18.9 |
| A04 | 14.1 |
| A05 | 16.6 |
| B01 | 17.9 |
| B02 | 18.3 |
| B03 | 23.9 |
| B04 | 18.0 |
| B05 | 16.3 |
| C01 | 12.9 |
| C02 | 14.7 |
| C03 | 14.1 |
| C04 | 15.5 |
| D01 | 12.8 |
| D02 | 11.7 |
| D03 | 15.9 |
| D04 | 16.6 |

TABLE 18

| the statistical result for the abrasion test of the alloys used for comparison | |
|---|---|
| Alloys used for comparison | Loss of weight after 30 minutes of abrasion (mg) |
| 1 | 36.7 |
| 2 | 40.9 |
| 3 | 37.4 |
| 5 | 40 |

TABLE 18-continued

| the statistical result for the abrasion test of the alloys used for comparison | |
|---|---|
| Alloys used for comparison | Loss of weight after 30 minutes of abrasion (mg) |
| 10 | 104 |
| 11 | 162 |

The statistical result in tables 17-18 is used to evaluate the abrasion assistance of the alloys according to the present invention, C69300, the traditional Bi-brass and Pb-brass C36000. The result indicates that the abrasion assistance of the alloys according to the present invention is significantly superior to that of Alloy 10 used for comparison (conventional Bi-brass) and Alloy 11 (namely C36000), and the alloys according to the present invention also have advantages on the abrasion assistance compared with Alloy 1 used for comparison (namely C69300).

It can be seen from all the above results that, the alloys according to the present invention possess excellent comprehensive performance, the chip shape and cuttability of which are comparable to that of Pb-brass C36000 and Si-brass C69300, and the corrosion resistance of which is significantly superior to that of conventional Bi-brass and Pb-brass C36000, no lower than Si-brass C69300. Compared with conventional Bi-brass, Pb-brass C36000 and Si-brass C69300, the thermoforming performance and corrosion resistance of the alloys according to the present invention show great improvement. Meanwhile, the release amount of toxic metal elements of the alloys according to the present invention into water meets the requirement of NSF detecting standard, the alloys according to the present invention belong to environment-friendly materials. Therefore, the alloys according to the present invention has more extensive market application prospect.

The examples above are described for the purpose of illustration and are not intend to limit the present invention, any modifications and changes made on the present invention without departing from the spirit or scope of the claims are considered to be within the protection scope of the present invention.

What is claimed is:

1. A corrosion-resistant brass alloy consisting of: 74.5-76.5 wt % Cu, 3.1-3.4 wt % Si, 0.11-0.2 wt % Fe, 0.04-0.10 wt % P, a combined amount of 0.001-0.003 wt % of at least one element selected from the group consisting of Ag, Ti and RE, and the balance being Zn and unavoidable impurities.

2. The brass alloy according to claim 1, wherein the content of Cu in the brass alloy is 75-76 wt %.

3. The brass alloy according to claim 1, wherein the content of P in the brass alloy is 0.04-0.08 wt %.

4. The brass alloy according to claim 1, wherein the at least one element selected from the group consisting of Ag, Ti and RE requires RE, and RE is 0.001-0.003 wt % in amount.

5. A corrosion-resistant brass alloy consisting of: 74.5-76.5 wt % Cu, 3.1-3.4 wt % Si, 0.11-0.2 wt % Fe, 0.04-0.10 wt % P, a combined amount of 0.001-0.003 wt % of at least one element selected from the group consisting of Ag, Ti and RE, a combined amount of 0.05-0.2 wt % of at least one element selected from the group consisting of Mn, Al, and Ni, and the balance being Zn and unavoidable impurities.

6. The brass alloy according to claim 5, wherein the at least one element selected from the group consisting of Ag, Ti and RE requires RE, and Re is 0.001-0.003 wt % in amount.

7. A corrosion-resistant brass alloy consisting of:

74.5-76.5 wt % Cu;

3.1-3.4 wt % Si;

0.11-0.2 wt % Fe;

0.04-0.10 wt % P;

a combined amount of 0.001-0.005 wt % of at least one element selected from the group consisting of Ag, Ti and RE;

0-0.25 wt % Pb;

0.01-0.4 wt % of Bi;

0.005-0.4 wt % Se;

0.005-0.4 wt % of Te;

a combined amount of 0.05-0.19 wt % of at least one element selected from the group consisting of Mn and Ni;

a combined amount of 0-0.15 wt % of at least one element selected from the group consisting of As and Sb; and the balance being Zn and unavoidable impurities.

8. The brass alloy according to claim 7, wherein the content of Cu in the brass alloy is 75-76 wt %.

9. The brass alloy according to claim 7, wherein the content of P in the brass alloy is 0.04-0.08 wt %.

10. The brass alloy according to claim 7, wherein the one element selected from the group consisting of Ag, Ti and RE requires RE, and RE is 0.001-0.003 wt % in amount.

11. A corrosion-resistant brass alloy consisting of: 74.5-6.5 wt % Cu, 3.1-3.4 wt % Si, 0.11-0.2 wt % Fe, 0.04-0.10 wt % P, a combined amount of 0.001-0.003 wt % of RE and optionally at least one element selected from the group consisting of Ag and Ti, a combined amount of 0.05-0.02 wt % of at least one element selected from the group consisting of Mn, Al, Sn and Ni, 0.03-0.15 wt % of at least one element selected from the group consisting of As and Sb, and the balance being Zn and unavoidable impurities, wherein when included, Sb is included at 0.03-0.05 wt %.

* * * * *